US012595808B1

(12) United States Patent
Shiraki et al.

(10) Patent No.: US 12,595,808 B1
(45) Date of Patent: Apr. 7, 2026

(54) CENTRIFUGAL FAN AND FIXING METHOD

(71) Applicant: MABUCHI MOTOR CO., LTD., Chiba (JP)

(72) Inventors: Kenji Shiraki, Chiba (JP); Tetsushi Yoshikawa, Chiba (JP); Sakie Kawakami, Chiba (JP)

(73) Assignee: MABUCHI MOTOR CO., LTD., Chiba (JP)

( * ) Notice: Subject to any disclaimer, the term of this patent is extended or adjusted under 35 U.S.C. 154(b) by 0 days.

(21) Appl. No.: 19/131,947

(22) PCT Filed: Oct. 4, 2024

(86) PCT No.: PCT/JP2024/035608
§ 371 (c)(1),
(2) Date: May 22, 2025

(51) Int. Cl.
*F04D 29/28* (2006.01)
*F04D 17/08* (2006.01)
*F04D 29/62* (2006.01)

(52) U.S. Cl.
CPC ..... *F04D 29/281* (2013.01); *F04D 17/08* (2013.01); *F04D 29/624* (2013.01)

(58) Field of Classification Search
CPC ..... F04D 29/281; F04D 29/824; F04D 17/08
See application file for complete search history.

(56) References Cited

U.S. PATENT DOCUMENTS 7,088,023 B1 * 8/2006 Gomyo ..... G11B 19/2009 310/90
9,065,315 B1 * 6/2015 Ochitani ..... G11B 19/2009
2013/0195634 A1 * 8/2013 Mashima ..... F04D 25/0613 415/191
2015/0176587 A1 * 6/2015 Tamaoka ..... F04D 29/023 417/354

(Continued)

FOREIGN PATENT DOCUMENTS

CN 109958635 A 7/2019
CN 109958636 A 7/2019

(Continued)

OTHER PUBLICATIONS

International Search Report in PCT Application No. PCT/JP2024/035608 mailed Dec. 17, 2024, 5pp.

(Continued)

*Primary Examiner* — Courtney D Heinle
*Assistant Examiner* — Cameron A Corday
(74) *Attorney, Agent, or Firm* — HAUPTMAN HAM, LLP

(57) ABSTRACT

A centrifugal fan includes a first portion in a rotor, and a second portion in a fan unit and having a greater linear coefficient of expansion than that of the first portion. The first portion has a top portion having a flat surface and a first tubular portion. The second portion has a main portion located in a first axial direction with respect to the top portion, a second tubular portion having an inner tube (Continued)

surface facing the outer tube surface of the first tubular portion with a clearance therebetween, an annular rib portion protruding from the main portion in a second axial direction, and a plurality of auxiliary rib portions. A bonding portion of an adhesive is provided between each of an annular end surface of the annular rib portion and the end surfaces of the plurality of auxiliary rib portions facing the flat surface, and the flat surface.

8 Claims, 6 Drawing Sheets

(56) References Cited

U.S. PATENT DOCUMENTS

| | | | | |
|---|---|---|---|---|
| 2019/0195231 | A1* | 6/2019 | Ida | F04D 25/0606 |
| 2019/0195235 | A1 | 6/2019 | Ida et al. | |
| 2019/0277309 | A1* | 9/2019 | Horii | F04D 25/0613 |

FOREIGN PATENT DOCUMENTS

| | | | |
|---|---|---|---|
| JP | 2019116847 | A | 7/2019 |
| JP | 2019116848 | A | 7/2019 |
| JP | 2023174079 | A | 12/2023 |
| JP | 2024048818 | A | 4/2024 |
| WO | 2023228608 | A1 | 11/2023 |

OTHER PUBLICATIONS

Written Opinion in PCT Application No. PCT/JP2024/035608 mailed Dec. 17, 2024, 7pp.

* cited by examiner

CENTRIFUGAL FAN AND FIXING METHOD

CROSS-REFERENCE TO RELATED APPLICATIONS

This application is a national stage entry according to 35 U.S.C. 371 of PCT Application No. PCT/JP2024/035608 filed on Oct. 4, 2024.

TECHNICAL FIELD

The present invention relates to a centrifugal fan and a fixing method for fixing a fan unit to a rotor of the centrifugal fan.

BACKGROUND ART

A centrifugal fan includes a fan unit having a plurality of blades and a motor unit serving as a drive source for the fan unit, and delivers fluid sucked from the vicinity of a rotation center to the radially outside of the fan unit as the fan unit rotates. Conventionally, there has been known a centrifugal fan in which a fan unit is fixed to a rotor of a motor unit such that the rotor and the fan unit are integrally rotated. For example, Patent Literature 1 discloses a centrifugal fan in which the outer peripheral surface of a metal rotor holder (rotor) provided in a motor (motor unit) and the inner peripheral surface of a blade support portion of a resin impeller (fan unit) are fixed with an adhesive.

CITATION LIST

Patent Literature

Patent Literature 1: JP-A-2019-116848

DISCLOSURE OF THE INVENTION

Problems to be Solved by the Invention

However, when the outer peripheral surface of the rotor holder and the inner peripheral surface of the blade support portion of the fan unit are bonded and fixed to each other as in Patent Literature 1, there is a possibility that the position of the center of gravity is misaligned due to thermal deformation depending on use environment of the centrifugal fan. The thermal deformation described here means that the fan unit of the centrifugal fan and a fixing member (rotor holder in Patent Literature 1) to which the fan unit is fixed change in dimension in accordance with a temperature or a temperature change around the centrifugal fan. The fan unit and the fixing member are often made of different materials, and for example, as in Patent Literature 1, the fan unit may be made of resin, and the fixing member may be made of metal. As described above, when the fan unit is formed of the material having a greater linear coefficient of expansion than that of the fixing member, the thermal deformation amount of the fan unit is greater than the thermal deformation amount of the fixing member, and thus, there is a possibility that the position of the center of gravity of the fan unit with respect to the fixing member is misaligned from the position before (at the beginning of) the thermal deformation. If the position of the center of gravity of the fan unit is misaligned, a fan balance may be adversely affected, and vibration and noise may be caused upon operation of the centrifugal fan. Therefore, in order to avoid the misalignment of the position of the center of gravity of the fan unit to the fixing member, it is conceivable to change the position of bonding of the fan unit to the fixing member, but in this case, it is a problem to ensure the bonding strength.

The centrifugal fan and the fixing method of the present invention have been devised in view of such a problem, and an object thereof is to reduce the misalignment of the position of the center of gravity due to the thermal deformation while ensuring the strength of bonding of the fan unit to the rotor. Note that objects of the present invention are not limited to this object, but also include another object of exerting operations and effects that can be derived from configurations presented in DESCRIPTION OF PREFERRED EMBODIMENTS described below, the operations and effects being unobtainable by the known technology.

Solutions to the Problems

The centrifugal fan and the fixing method of the disclosure can be achieved as aspects (application examples) disclosed below, and solve at least some of the above-described problems.

The centrifugal fan according to the disclosure includes a first portion provided in a rotor that rotates integrally with a shaft, and a second portion provided in a fan unit having a plurality of blades and fixed to the rotor and having a greater linear coefficient of expansion than that of the first portion. The first portion includes a top portion extending from a first hole through which the shaft is inserted toward the radially outside of the shaft and having a flat surface facing a first axial direction in the axial direction of the shaft, and a first tubular portion having a tubular shape and extending from a radially outside end portion of the top portion in a second axial direction opposite to the first axial direction. The second portion includes a main portion located in the first axial direction with respect to the top portion and extending to the radially outside from a second hole through which the shaft is inserted, an annular rib portion protruding from the main portion in the second axial direction and having an annular end surface having an annular shape and facing the flat surface, a plurality of auxiliary rib portions protruding from the main portion in the second axial direction, radially extending from the annular rib portion in the radial direction, and having end surfaces facing the flat surface, and a second tubular portion having a tubular shape, extending in the second axial direction from a radially outside end portion of the main portion, and having an inner tube surface facing the outer tube surface of the first tubular portion with a clearance therebetween. A bonding portion formed of an adhesive is provided between each of the annular end surface of the annular rib portion and the end surfaces of the plurality of auxiliary rib portions and the flat surface.

The fixing method of the disclosure is a fixing method for fixing, to a first portion provided in a rotor of a motor unit having the rotor that rotates integrally with a shaft and a stator disposed so as to face the rotor, a second portion provided in a fan unit having a plurality of blades and having a greater linear coefficient of expansion than that of the first portion. The first portion is provided with a top portion extending to a radially outside from a first hole through which the shaft is inserted and having a flat surface facing a first axial direction, and a first tubular portion extending from a radially outside end portion of the top portion in a second axial direction opposite to the first axial direction. The second portion is provided with a main portion extending to the radially outside from a second hole through which the shaft is inserted, an annular rib portion protruding from the main portion and having an annular end surface having an annular shape, a plurality of auxiliary rib portions protruding from the main portion in a direction identical to that of the annular rib portion, radially extending from the annular rib portion in a radial direction, and having end surfaces facing a direction identical to that of the annular end surface, and a second tubular portion extending from a radially outside end portion of the main portion in a direction identical to that of the annular rib portion. The fixing method includes a first step of applying an adhesive to the annular end surface or applying an adhesive to a portion facing the annular end surface when the main portion of the second portion is disposed on a first axial direction side with respect to the top portion of the first portion on the flat surface, a second step of disposing the main portion of the second portion on the first axial direction side with respect to the top portion of the first portion and making the annular end surface and the end surfaces face the flat surface, and a third step of making the inner tube surface of the second tubular portion face the outer tube surface of the first tubular portion with a clearance therebetween and expanding the adhesive between the annular end surface and the flat surface and between the end surfaces and the flat surface.

Effects of the Invention

According to the centrifugal fan and the fixing method of the disclosure, it is possible to reduce the misalignment of the position of the center of gravity due to the thermal deformation while ensuring the strength of bonding of the fan unit to the rotor.

DESCRIPTION OF PREFERRED EMBODIMENTS

A centrifugal fan and a fixing method as an embodiment will be described with reference to the drawings. The embodiment presented below is a mere exemplification. There is no intention to preclude various modifications and application of a technology, which are not explicitly stated in the embodiment below. The configurations of the embodiment can be modified and carried out in various manners within the scope that does not depart from the purport of the configurations.

1. Configuration

Figure 1:
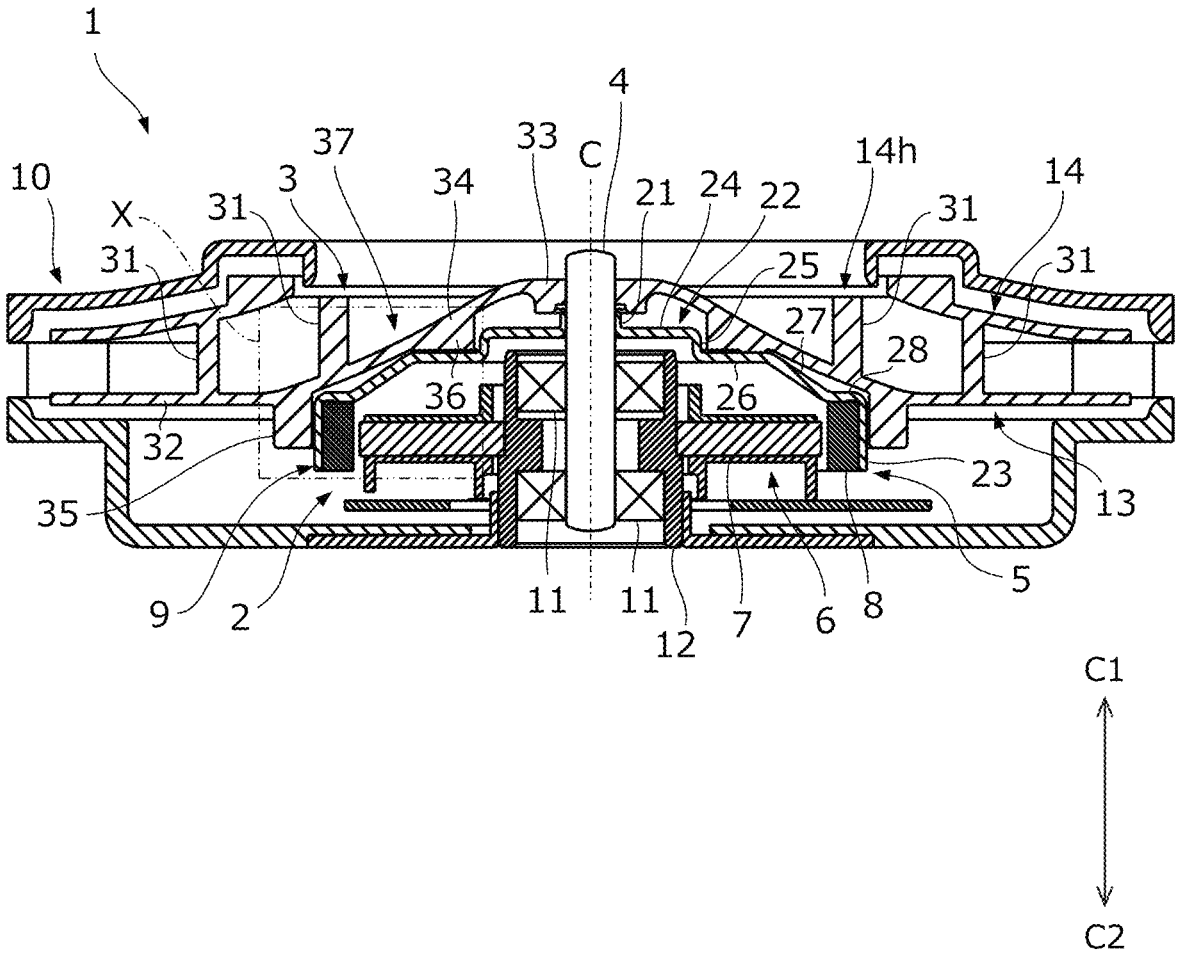
FIG. 1 is a sectional view of a centrifugal fan of an embodiment taken along an axial direction.

FIG. 1 is a sectional view of a centrifugal fan 1 of the present embodiment taken along an axial direction. As shown in FIG. 1, the centrifugal fan 1 includes a motor unit 2 as a drive source and a fan unit 3 to be driven by the motor unit 2. The centrifugal fan 1 is configured such that, for example, the motor unit 2 and the fan unit 3 are incorporated in a housing 10 forming an outer shell of the centrifugal fan 1. The motor unit 2 has a shaft 4, a rotor 5 that rotates integrally with the shaft 4, and a stator 6 disposed so as to face the rotor 5. The fan unit 3 is attached to one side (first axial direction C1 side described later) in the axial direction of the shaft 4 with respect to the rotor 5 of the motor unit 2 and is fixed to the rotor 5 with an adhesive, thereby rotating integrally with the shaft 4 and the rotor 5. The centrifugal fan 1 may be used as, for example, a ventilation fan attached to a seat of a vehicle.

Hereinafter, a state in which the fan unit 3 is attached and fixed to the rotor 5 of the motor unit 2 will be referred to as a fixed state. A state before the fixed state will be referred to as a pre-fixing state. In the pre-fixing state, a state in which the fan unit 3 is attached to the rotor 5 on one side in the axial direction (the fan unit 3 is placed on one side in the axial direction) will be referred to as an attached state, and a state before the attached state (a state in which the fan unit 3 and the rotor 5 are separated) will be referred to as a pre-attachment state. The centrifugal fan 1 is brought into the fixed state by the adhesive applied to the fan unit 3 in the pre-attachment state being expanded (spread) and cured between the fan unit 3 and the rotor 5 when being brought into the attached state. The fan unit 3 is bonded and fixed to the rotor 5 with a bonding portion 40 (see FIGS. 5 and 6) formed by curing the adhesive, thereby rotating integrally with the shaft 4 and the rotor 5. In the following description, the centrifugal fan 1 is assumed to be in the fixed state unless otherwise specified.

Hereinafter, the extending direction of the shaft 4 (the direction of the axis C of the shaft 4) will be referred to as an axial direction. In the axial direction, a direction in which the fan unit 3 is attached to the motor unit 2 will be referred to as a first axial direction C1, and a direction opposite to the first axial direction C1 will be referred to as a second axial direction C2. In addition, a direction orthogonal to the axial direction and away from the axis C of the shaft 4 will be referred to as radially outside, and a direction orthogonal to the axial direction and toward the axis C will be referred to as radially inside. In a case where the radially inside and outside are not distinguished from each other, these directions will be simply referred to as a radial direction. A direction orthogonal to the axial direction and around the axis C will be referred to as a circumferential direction.

As described above, the motor unit 2 has the shaft 4, the rotor 5, and the stator 6. The motor unit 2 of the present embodiment is an outer rotor type motor, and as shown in FIG. 1, the stator 6 is disposed radially inside the rotor 5. The shaft 4 extends, for example, from the second axial direction C2 side with respect to the stator 6 to the first axial direction C1 side with respect to the fan unit 3. An end portion of the shaft 4 on the second axial direction C2 side and an intermediate portion of the shaft 4 in the axial direction may be rotatably supported by a bearing 11. The bearing 11 is held by a cylindrical bearing holder 12 fixed to the housing 10.

The stator 6 includes an annular stator core 7 in which a plurality of steel plates having the same shape is stacked on each other. The stator 6 may be provided with a coil (not shown) wound around the stator core 7 through an insulator. The stator core 7 is non-rotatably fixed to the housing 10 by being fitted and fixed onto the bearing holder 12 in a state in which the stacking direction of the steel plates coincides with the axial direction at the center thereof.

The rotor 5 includes a magnet 8 and the rotor yoke 9 disposed so as to face the stator core 7 in the radial direction. The magnet 8 is formed of, for example, a long rectangular rubber magnet, and is formed by connecting both ends of the rubber magnet in an annular shape having an inner diameter greater than the outer diameter of the stator core 7. The magnet 8 is fixed to the rotor yoke 9, and is disposed so as to face the radially outside of the stator core 7 with a gap therebetween.

The rotor yoke 9 is a member that fixes the magnet 8 such that the magnet 8 is not rotatable relative to the shaft 4 and reduces leakage of a magnetic line of the magnet 8, and is formed of, for example, a magnetic steel plate (metal). The rotor yoke 9 has, for example, a bottomed cylindrical shape (cup shape) opened in the second axial direction C2, and covers the stator 6 from the first axial direction C1 side. The rotor yoke 9 is provided with a first hole 21 through which the shaft 4 is inserted, a first tubular portion 23 having a tubular shape and located on the radially outside of the stator core 7, and a top portion 22 connecting the first hole 21 and the first tubular portion 23 to each other.

The first hole 21 is a portion forming a through-hole 21*h* (see FIG. 2) through which the shaft 4 is inserted, and has, for example, a cylindrical shape concentric with the axis C. The rotor yoke 9 is fixed to the shaft 4 so as not to rotate relative to the shaft 4 by inserting the shaft 4 into the through-hole 21*h* and press-fitting and fixing the first hole 21 to the shaft 4.

Figure 2:
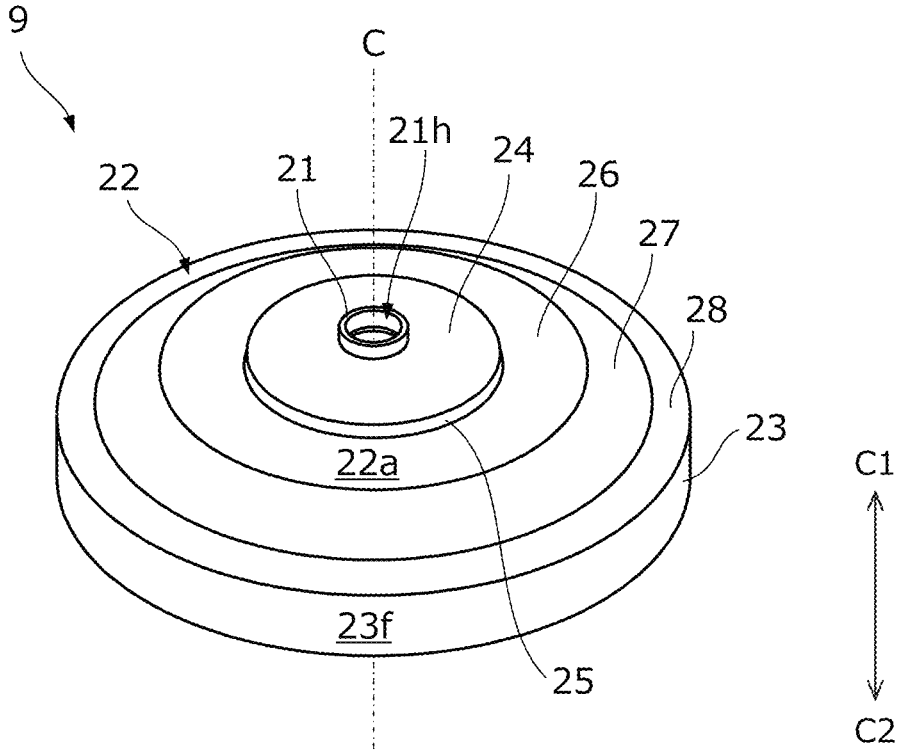
FIG. 2 is a perspective view of a rotor yoke provided in a rotor of a motor unit of the centrifugal fan of FIG. 1.
Figure 5:
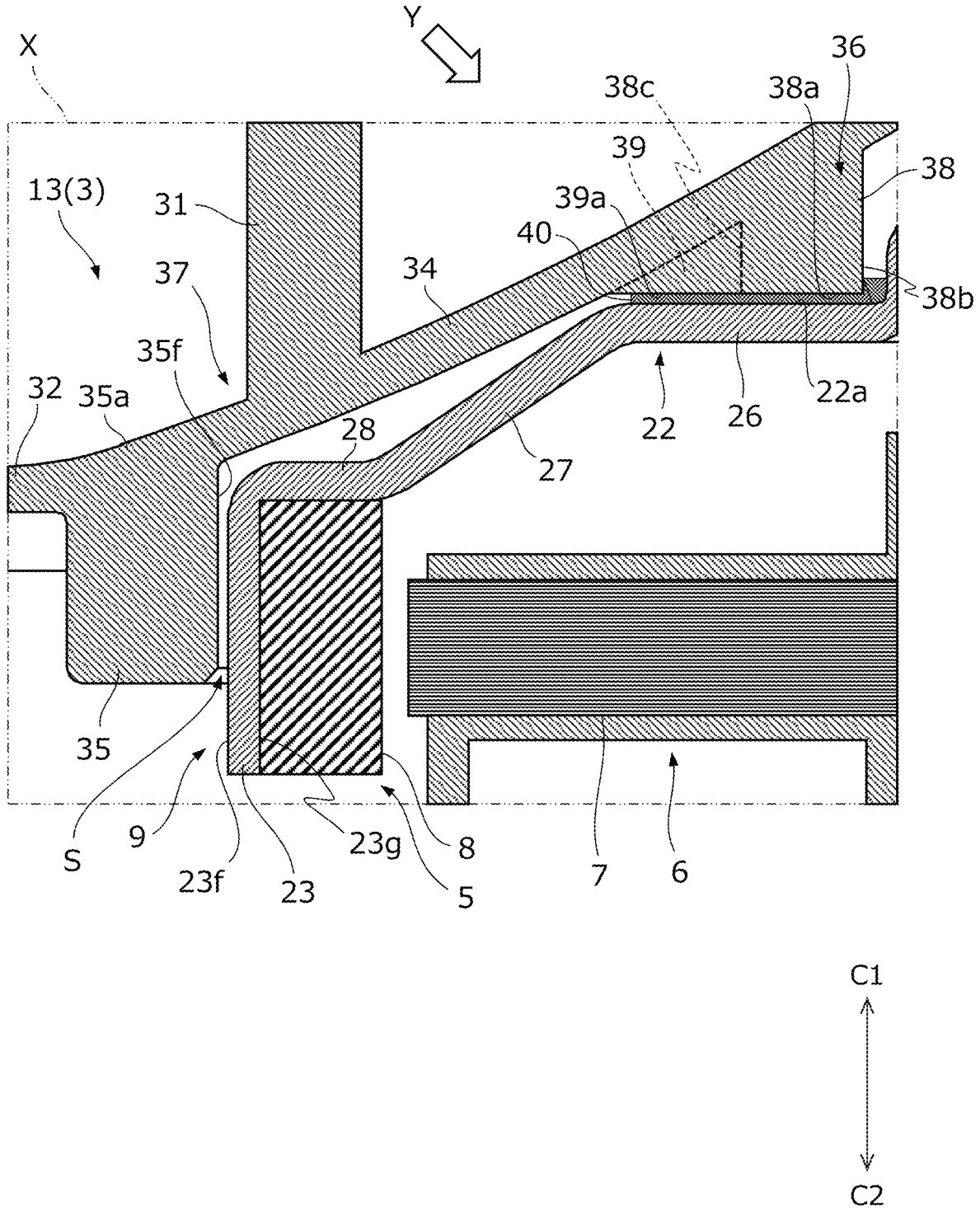
FIG. 5 is an enlarged view of a portion X in FIG. 1.

The first tubular portion 23 is a portion for fixing the magnet 8, and as shown in FIG. 1, is provided so as to surround the stator core 7 from the radially outside. The first tubular portion 23 has, for example, a cylindrical shape concentric with the axis C, and extends in the axial direction. As shown in FIGS. 2 and 5, the first tubular portion 23 has an inner tube surface 23*g* (see FIG. 5) facing the radially inside and an outer tube surface 23*f* facing the radially outside. The diameter of the inner tube surface 23*g* is set to be greater than the outer diameter of the stator core 7. The magnet 8 is fixed to the inner tube surface 23*g* so as not to rotate relative to the shaft 4.

As shown in FIG. 1, the top portion 22 is a portion covering the magnet 8 and the stator 6 from the first axial direction C1 side. For example, as shown in FIGS. 1 and 2, the top portion 22 extends to the radially outside from an end portion of the first hole 21 on the second axial direction C2 side and is connected to an end portion of the first tubular portion 23 on the first axial direction C1 side. Note that the term "extending toward" as used herein is not limited to extending in a direction coincident with (parallel to) a reference direction (for example, the radial direction), and includes extending in a direction inclined with respect to the reference direction. Hereinafter, the same also applies to a case of describing "extending toward".

The top portion 22 may be configured by combining a flat portion, a curved portion, and a stepped or tapered portion (parts). The top portion 22 described here as an example includes an inner flat portion 24, a stepped portion 25, an intermediate flat portion 26, a slope portion 27, and an outer flat portion 28, and these portions 24 to 28 are continuously provided in this order from the radially inside to the radially outside. As shown in FIG. 2, each of the inner flat portion 24, the intermediate flat portion 26, the slope portion 27, and the outer flat portion 28 has a circular ring shape concentric with the axis C as viewed in the axial direction. The stepped portion 25 has a cylindrical shape concentric with the axis C, and extends in the axial direction.

As shown in FIG. 1, the inner flat portion 24 is connected to the second axial direction C2 side of the first hole 21, and extends to the radially outside. The stepped portion 25 is connected to the radially outside of the inner flat portion 24, and extends in the second axial direction C2. The intermediate flat portion 26 is connected to the second axial direction C2 side of the stepped portion 25, and extends to the radially outside. The slope portion 27 is connected to the radially outside of the intermediate flat portion 26, and extends to the radially outside and the second axial direction C2 side (obliquely). The outer flat portion 28 is connected to the radially outside of the slope portion 27, and extends to the radially outside. An end portion of the first tubular portion 23 on the first axial direction C1 side is connected to a radially outside end portion of the outer flat portion 28. With these portions 24 to 28, the top portion 22 extends, as a whole, to the radially outside and the second axial direction C2 side from the first hole 21. Note that the term "connection" used in the present specification means that two portions are connected to each other, and does not mean that two portions provided separately are connected (joined) to each other.

In the present embodiment, the fan unit 3 is bonded and fixed to the rotor yoke 9. That is, the rotor yoke 9 corresponds to a "first portion" described in the claims. Although a specific configuration will be described later, in the fan unit 3, a rib portion 36 provided at the fan unit 3 is bonded and fixed to a surface (see FIGS. 2, 5, and 6) of the intermediate flat portion 26 of the top portion 22 facing the first axial direction C1. Hereinafter, this surface will be referred to as a bonding surface 22*a* (flat surface).

Figure 3:
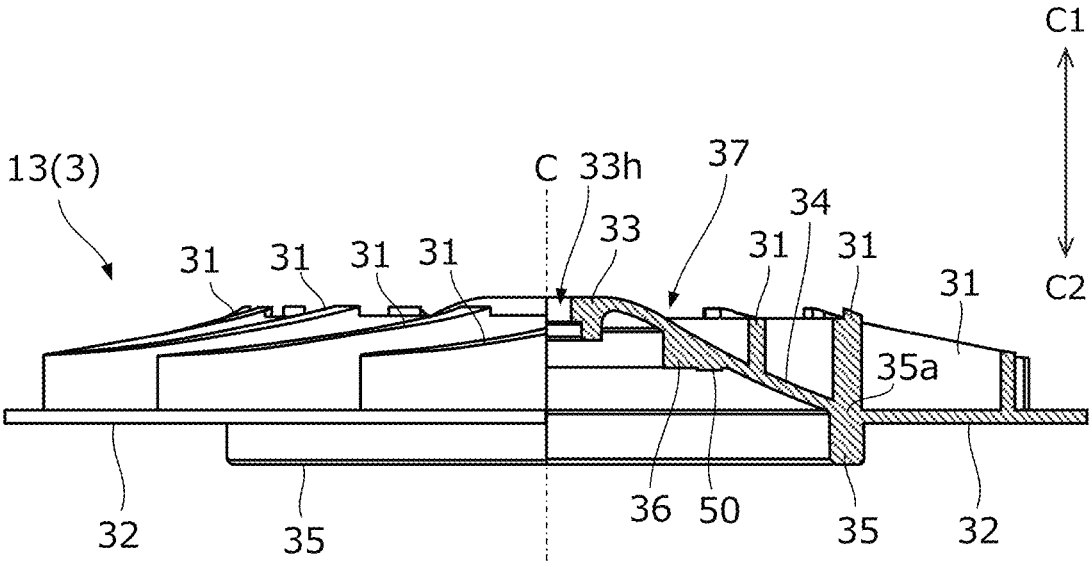
FIG. 3 is a half sectional view, which is taken along the axial direction, of a bladed main plate provided in a fan unit of the centrifugal fan of FIG. 1.

The fan unit 3 is an impeller that delivers fluid sucked from the radially inside to the radially outside, and includes a plurality of blades 31 standing in the axial direction as shown in FIG. 3. The plurality of blades 31 is arranged at equal intervals in the circumferential direction around the axis C. The fan unit 3 may be provided with the main plate portion 32 that supports end portions of the plurality of blades 31 on the second axial direction C2 side.

As shown in FIG. 1, the fan unit 3 may include the bladed main plate 13 in which the plurality of blades 31 and the main plate portion 32 are integrally molded, and a shroud 14. The fan unit 3 is configured, for example, by attaching and fixing the shroud 14 to the bladed main plate 13 on the first axial direction C1 side. The bladed main plate 13 and the shroud 14 are, for example, separately molded from resin having a greater linear coefficient of expansion than that of the rotor yoke 9 and then combined.

The shroud 14 is a plate member fixed to the end portions of the plurality of blades 31 on the first axial direction C1 side, and has a circular ring shape in which an air passage hole 14*h* for an air suction guiding path is formed on the radially inside. The shroud 14 is fixed to the bladed main plate 13 by, for example, ultrasonic welding.

Figure 4:
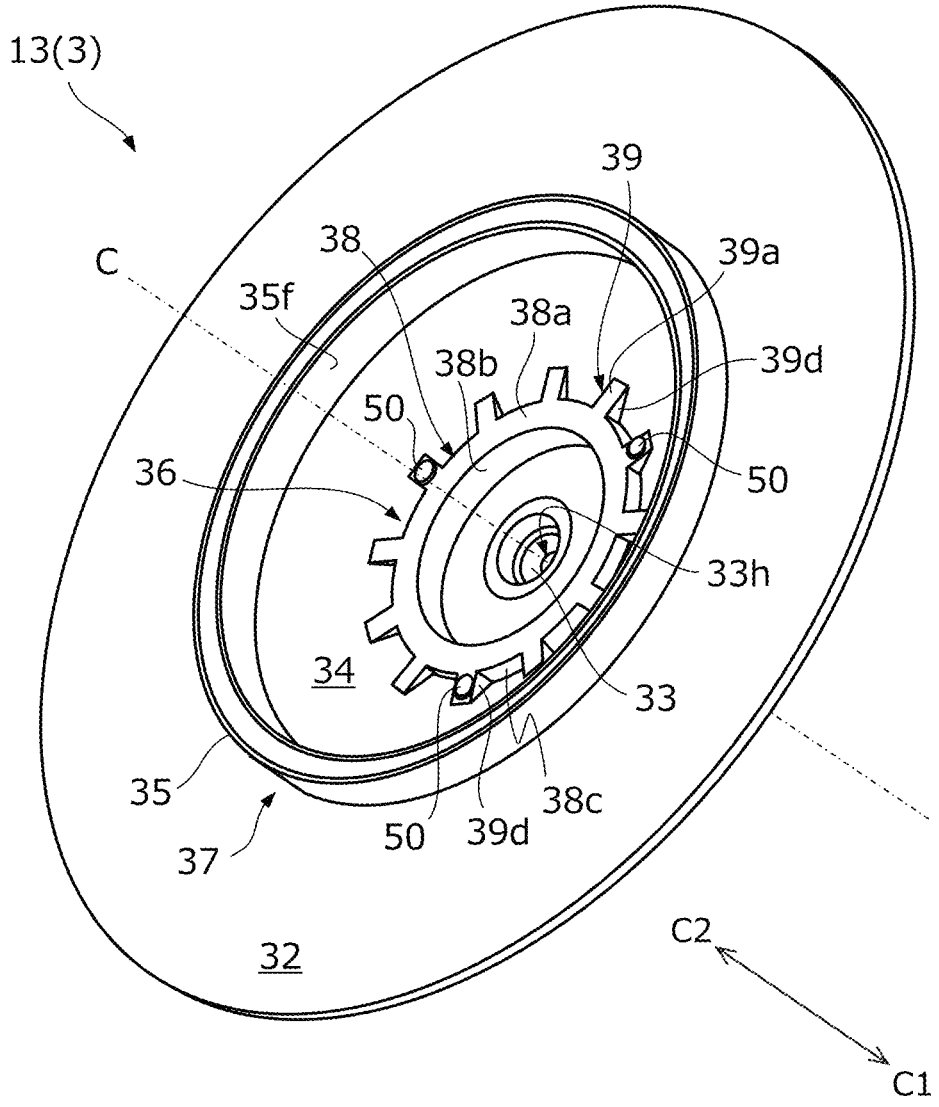
FIG. 4 is a perspective view of the bladed main plate of FIG. 3 as viewed in a second axial direction.

The bladed main plate 13 includes the blades 31 and the main plate portion 32 as described above. The main plate portion 32 of the present embodiment is provided radially outside the first tubular portion 23 of the rotor yoke 9. For example, as shown in FIGS. 1, 3, and 4, the main plate portion 32 has a flat plate shape with a uniform dimension (thickness, plate thickness) in the axial direction, and has a circular ring shape concentric with the axis C as viewed in the axial direction.

The bladed main plate 13 further includes a second hole 33, a main portion 34, a second tubular portion 35, and the rib portion 36. These portions 33 to 36 are provided radially inside the main plate portion 32. In the present embodiment, these portions 33 to 36 correspond to a "second portion" described in the claims.

The second hole 33 is a hole through which the shaft 4 is inserted. The second hole 33 is a portion forming a through-hole 33*h* (see FIGS. 3 and 4) through which the shaft 4 is inserted, and has, for example, a cylindrical shape concentric with the axis C. The inner diameter of the second hole 33 is set to be equal to the outer diameter of the shaft 4 or slightly greater than the outer diameter of the shaft 4, for example. Note that the second hole 33 may or may not be fixed to the shaft 4.

The main portion 34 is a portion extending to the radially outside from the second hole 33, has a plate shape having a substantially uniform dimension (thickness, plate thickness) in a direction orthogonal to the extending direction, and has a circular ring shape concentric with the axis C as viewed in the axial direction. For example, the main portion 34 extends (obliquely) to the radially outside and the second axial direction C2 side from the second hole 33 in accordance with the extending direction of the top portion 22 of the rotor yoke 9, and is connected to the radially inside of the main plate portion 32. Thus, the main portion 34 covers the rotor yoke 9 from the first axial direction C1 side. In other words, the main portion 34 extends obliquely with respect to the axial direction so as to form a mountain protruding toward the first axial direction C1 side as viewed in the radial direction. With such a main portion 34, the fluid sucked from the first axial direction C1 side is easily guided to the second axial direction C2 side and the radially outside along the extending direction of the main portion 34.

Note that as shown in FIGS. 1 and 3, the end portions of the plurality of blades 31 on the second axial direction C2 side may be connected not only to the main plate portion 32 but also to the main portion 34. That is, the main portion 34 may have the function of the main plate portion 32 (function of supporting the end portions of the plurality of blades 31 on the second axial direction C2 side) together with the main plate portion 32. The thickness of the main portion 34 is preferably equal to the thickness of the main plate portion 32.

The second tubular portion 35 is a tubular portion extending in the second axial direction C2 from a radially outside end portion of the main portion 34 (i.e., the position of a boundary between the main plate portion 32 and the main portion 34). For example, as shown in FIG. 4, each of the inner tube surface 35*f* facing the radially inside and the outer tube surface facing the radially outside has a cylindrical shape having a uniform diameter in the axial direction, and is concentric with the axis C. As shown in FIG. 1, the second tubular portion 35 extends to a position overlapping with the first tubular portion 23 of the rotor yoke 9 as viewed in the radial direction, and surrounds the first tubular portion 23 of the rotor yoke 9 from the radially outside. As shown in FIG. 5, the inner tube surface 35*f* of the second tubular portion 35 faces the outer tube surface 23*f* of the first tubular portion 23.

As shown in FIGS. 1, 3, and 4, a radially inside portion of the main plate portion 32 of the bladed main plate 13 has a bottomed cylindrical shape (cup shape) opened toward the second axial direction C2 by the second hole 33, the main portion 34, and the second tubular portion 35. Hereinafter, these portions 33 to 35 will also be collectively referred to as a cup portion 37.

The rib portion 36 is a portion protruding from the main portion 34 in the second axial direction C2 and reinforcing the main portion 34. In the present embodiment, as described above, the rib portion 36 is bonded and fixed to the bonding surface 22*a* of the rotor yoke 9. Therefore, at least part of the rib portion 36 is disposed at a position overlapping with at least part of the bonding surface 22*a* as viewed in the axial direction. As shown in FIG. 1, the rib portion 36 is preferably provided at a position apart from the second tubular portion 35 to the radially inside and at a position apart from the second hole 33 to the radially outside.

Here, in a case where the bladed main plate 13 (fan unit 3) having the cup portion 37 described above is made of a material having a greater linear coefficient of expansion than that of the rotor yoke 9 to which the bladed main plate 13 is fixed, the fan unit 3 may be thermally deformed more greatly than the rotor yoke 9 when exposed to environment where a temperature change therearound is severe. The inventors of the present invention have found that the thermal deformation of the cup portion 37 described above includes a tendency of the second tubular portion 35 being deformed so as to be reduced in diameter with the position of a boundary between the main portion 34 and the second tubular portion 35 as a base point and a tendency of the main portion 34 being deformed so as to float upward to the first axial direction C1 side.

In addition, it has been found that the latter one (i.e., the upward deformation of the main portion 34) of these deformation tendencies is caused due to the misalignment of the position of the center of gravity of the fan unit 3. Furthermore, it has been found as follows. In the conventional centrifugal fan in which the adhesive is provided between the tubular portion of the rotor and the tubular portion of the fan unit, even if the tubular portion of the fan unit is about to be reduced in diameter due to the temperature change, such deformation is blocked by the adhesive. Since the deformation of the tubular portion is blocked, it is possible to replace such deformation with the upward deformation of a top portion of the fan unit (the amount of the upward deformation increases as compared with a case where the deformation of the tubular portion is not blocked).

Therefore, in the centrifugal fan 1 of the present invention, as shown in FIG. 5, a clearance S is provided between the first tubular portion 23 and the second tubular portion 35 such that even if the second tubular portion 35 is deformed so as to be reduced in diameter, such deformation is not blocked. Further, in order to leave the clearance S as a space, a location to be bonded is changed, and the top portion 22 and the rib portion 36 are bonded and fixed to each other. As a result, the diameter-reducing deformation of the second tubular portion 35 is allowed, so that such deformation is not replaced with the upward deformation of the main portion 34, and conversion of the force for deforming the second tubular portion 35 such that the diameter thereof is reduced into the force for deforming the main portion 34 is reduced. Therefore, the upward deformation of the main portion 34 is reduced, and the misalignment of the position of the center of gravity of the fan unit 3 is reduced.

The clearance S is a tubular space (gap) having a small dimension in the radial direction and formed between the outer tube surface 23*f* of the first tubular portion 23 and the inner tube surface 35*f* of the second tubular portion 35. For example, the dimension of the clearance S in the radial direction is set to such a size that the second tubular portion 35 does not come into contact with the first tubular portion 23 even when the second tubular portion 35 is deformed so as to be reduced in diameter. The diameter of the inner tube surface 35*f* of the second tubular portion 35 is set to such a size that such a clearance S can be formed between the inner tube surface 35*f* and the outer tube surface 23*f* of the first tubular portion 23.

In the present embodiment, as shown in FIG. 5, a portion at the position of a boundary between the plate-shaped main portion 34 and the second tubular portion 35 having a uniform diameter in the axial direction may have a relatively greater wall thickness than those of other portions of the bladed main plate 13. Note that the term "greater wall thickness" as used herein means that the wall (resin) of the fan unit 3 is thickened by joining each portion forming the fan unit 3. Hereinafter, this portion will be referred to as a "thick portion 35*a*".

In the present embodiment, as described above, the end portions of the plurality of blades 31 on the second axial direction C2 side are connected to the main portion 34, and the radially inside end portion of the main plate portion 32 is connected to the radially outside end portion of the main portion 34. Therefore, as shown in FIG. 3, in the thick portion 35*a*, the thickness may be further increased at a portion where base portions of the blades 31 in the second axial direction C2 and a radially inside base portion of the main plate portion 32 are gathered.

With such a thick portion 35*a*, the tendency of the above-described thermal deformation of the cup portion 37 is more easily observed in the fan unit 3. However, since the diameter-reducing deformation of the second tubular portion 35 starting from the thick portion 35*a* is allowed by the clearance S, the deformation of the main portion 34 is reduced. Note that in the present embodiment, it is also said that the rib portion 36 described above is provided at a position apart from the second tubular portion 35, i.e., a position apart from the thick portion 35*a*.

Furthermore, the centrifugal fan 1 of the present invention is provided with a configuration for increasing the bonding strength of the fan unit 3 to the rotor yoke 9. Specifically, as shown in FIGS. 4 and 5, as the rib portion 36, an annular rib portion 38 and a plurality of auxiliary rib portions 39 protruding from the main portion 34 in the second axial direction C2 are provided. In the centrifugal fan 1, the adhesive applied to an annular end surface 38*a* of the annular rib portion 38 on the second axial direction C2 side spreads when brought into the attached state, so that the adhesive is expanded not only between the annular end surface 38*a* and the bonding surface 22*a*, but also between end surfaces 39*a* of the plurality of auxiliary rib portions 39 on the second axial direction C2 side and the bonding surface 22*a*. In other words, it is also expressed that the adhesive applied to the annular end surface 38*a* of the annular rib portion 38 spreads when brought into the attached state, whereby the adhesive is entangled with the annular rib portion 38 and the plurality of auxiliary rib portions 39. In the centrifugal fan 1, the rib portion 36 is fixed to the bonding surface 22*a* by the bonding portion 40 (see FIG. 5) formed by curing the adhesive, and the bonding strength of the fan unit 3 to the rotor yoke 9 is ensured.

The annular rib portion 38 is a portion protruding from the main portion 34 in the second axial direction C2, and has an annular end surface 38*a* facing the second axial direction C2. The annular end surface 38*a* is an annular flat surface extending around the axis C as viewed in the second axial direction C2, and faces the bonding surface 22*a*. For example, as shown in FIG. 4, the annular rib portion 38 may have a cylindrical shape having the circular ring-shaped annular end surface 38*a* concentric with the axis C, an inner peripheral surface 38*b* facing the radially inside, and an outer peripheral surface 38*c* facing the radially outside.

The plurality of auxiliary rib portions 39 protrudes from the main portion 34 in the same direction as that of the annular rib portion 38 (i.e., the second axial direction C2), and radially extends from the annular rib portion 38 in the radial direction. In the present embodiment, the plurality of auxiliary rib portions 39 is provided radially outside the annular rib portion 38, and radially extends to the radially outside from the annular rib portion 38. The plurality of auxiliary rib portions 39 may have the same shape, and may be provided apart from each other at equal intervals in the circumferential direction. Here, 12 auxiliary rib portions 39 having the same shape are provided apart from each other at equal intervals on the radially outside of the annular rib portion 38. Note that in FIG. 4, only one of the 12 auxiliary rib portions 39 is denoted by a reference numeral.

Each auxiliary rib portion 39 has the end surface 39*a* facing the second axial direction C2. Each end surface 39*a* faces the bonding surface 22*a*. Each auxiliary rib portion 39 has, for example, a substantially triangular prism shape having the rectangular end surface 39*a* and a pair of triangular side surfaces 39*d* facing opposite directions in the circumferential direction. Hereinafter, the end surface 39*a* will also be referred to as a rectangular end surface 39*a*. As shown in FIGS. 4 and 5, each auxiliary rib portion 39 extends to the same position as that of the annular rib portion 38 in the axial direction. The annular end surface 38*a* of the annular rib portion 38 and the rectangular end surface 39*a* of each auxiliary rib portion 39 thereby form one continuous flat surface (flat surface orthogonal to the axial direction).

Note that the width of the auxiliary rib portion 39 in the circumferential direction is preferably set equal to the width of the annular rib portion 38 in the radial direction. The width of the annular rib portion 38 in the radial direction and the width of the auxiliary rib portion 39 in the circumferential direction are more preferably widths capable of ensuring a bonding area for obtaining a bonding strength satisfying the specifications of the centrifugal fan 1, and are preferably set to be slightly greater than the thicknesses of the main portion 34 and the main plate portion 32. As a result, when the bladed main plate 13 is molded, shape distortion caused by a difference in curing time due to a difference in resin amount is reduced.

Figure 6:
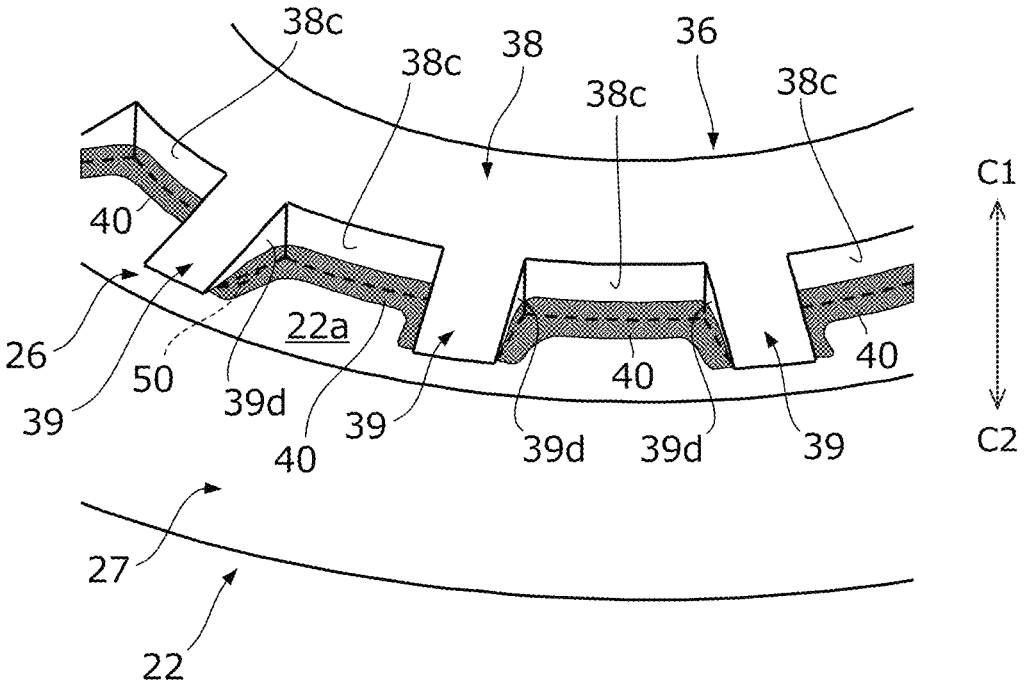
FIG. 6 is a perspective view showing an intermediate flat portion and a slope portion of the rotor yoke and an annular rib portion and a plurality of auxiliary rib portions of the bladed main plate in the centrifugal fan in FIG. 1 as viewed from a radially outside and a first axial direction side (direction of an arrow Y in FIG. 5).

As shown in FIGS. 3 and 4, some of the plurality of auxiliary rib portions 39 may be provided with protrusions 50 protruding from the rectangular end surface 39*a* in the second axial direction C2. The protrusion 50 is a portion provided for forming a space (gap) in which the bonding portion 40 is interposed between each of the annular end surface 38*a* and the rectangular end surface 39*a* and the bonding surface 22*a*, and contacts (abuts on) the bonding surface 22*a* in the attached state as shown in FIG. 6. The number of protrusions 50 is preferably three or more. In this case, it is preferable that the three or more protrusions 50 are provided apart from each other at equal intervals in the circumferential direction, and it is preferable that the protruding amount from the rectangular end surface 39*a* is set to be equal among these protrusions.

Here, as shown in FIG. 4, the protrusions 50 are provided for each of three auxiliary rib portions 39 provided every third of the 12 auxiliary rib portions 39. Such protrusions 50 abut on the bonding surface 22*a* of the rotor yoke 9, so that the annular end surface 38*a* and the rectangular end surface 39*a* are arranged in parallel with the bonding surface 22*a*. Therefore, the width of the gap (space), which is formed between each of the annular end surface 38*a* and the rectangular end surface 39*a* and the bonding surface 22*a*, in the axial direction is uniform, and the balance of bonding of the fan unit 3 to the rotor 5 is improved.

Note that the protruding amount of the protrusion 50 from the rectangular end surface 39*a* is preferably set to be equal to an optimum film thickness of the adhesive. Here, the optimum film thickness means a film thickness when the bonding strength obtained by the adhesive is a strength capable of withstanding a load assumed upon use as the centrifugal fan 1. For example, for the adhesive satisfying the specifications of the centrifugal fan 1, a relationship between the film thickness and the bonding strength may be verified by experiment, simulation, or the like, and the optimum film thickness may be determined based on the verification result.

As described above, the bonding portion 40 is the portion formed by spreading and curing the adhesive applied to the annular end surface 38*a* in the pre-attachment state when brought into the attached state. The bonding portion 40 is provided at least between the annular end surface 38*a* and the bonding surface 22*a* and between the rectangular end surface 39*a* and the bonding surface 22*a*.

In the present embodiment, as shown in FIGS. 5 and 6, the bonding portion 40 is provided not only between each of the annular end surface 38*a* and the rectangular end surface 39*a* and the bonding surface 22*a*, but also on the radially inside of the annular rib portion 38, the radially outside of the annular rib portion 38, and both sides of the auxiliary rib portion 39 in the circumferential direction. That is, the applied adhesive spreads from the bonding surface 22*a* to each of the inner peripheral surface 38*b* of the annular rib portion 38, the outer peripheral surface 38*c* of the annular rib portion 38, and the pair of side surfaces 39*d* of the auxiliary rib portion 39, and the bonding portion 40 is also provided for these portions. As a result, not only the annular end surface 38*a* and the rectangular end surface 39*a* but also the inner peripheral surface 38*b*, the outer peripheral surface 38*c*, and the side surfaces 39*d* are bonded and fixed to the bonding surface 22*a*, so that the strength of bonding of the fan unit 3 to the rotor 5 is further increased. In particular, the bonding strength in the circumferential direction (i.e., the rotation direction of the fan unit 3) is further enhanced.

Note that in order to form such a bonding portion 40, it is preferable that a greater amount of adhesive than the capacity of the gap formed between the bonding surface 22*a* and the annular end surface 38*a* in the attached state is applied to the annular end surface 38*a* in the pre-attachment state. More preferably, a greater amount (hereinafter, referred to as an "excessive amount") of the adhesive than the capacity of the gap formed between the bonding surface 22*a* and each of the annular end surface 38*a* and the rectangular end surface 39*a* in the attached state is applied to the annular end surface 38*a* in the pre-attachment state.

2. Fixing Method

Hereinafter, a method (steps) for fixing the fan unit 3 (bladed main plate 13) to the rotor 5 (rotor yoke 9) in the centrifugal fan 1 described above will be described. This fixing method includes three steps of a first step, a second step, and a third step.

First, in the first step, the adhesive is applied to the annular end surface 38*a* of the bladed main plate 13 in the pre-attachment state. That is, the first step is a step of applying the adhesive to the annular end surface 38*a*. In the first step, for example, an excessive amount of adhesive is uniformly applied to the entire annular end surface 38*a* having the annular shape.

In the subsequent second step, the bladed main plate 13 in the pre-attachment state is disposed concentrically with the rotor yoke 9 on the first axial direction C1 side with respect to the rotor yoke 9. That is, the main portion 34 is disposed concentrically with the top portion 22 on the first axial direction C1 side with respect to the top portion 22. As a result, the annular end surface 38*a* and the rectangular end surface 39*a* face the bonding surface 22*a*. That is, the second step is a step of disposing the main portion 34 of the bladed main plate 13 on the first axial direction C1 side with respect to the top portion 22 of the rotor yoke 9, and making the annular end surface 38*a* and the rectangular end surface 39*a* face the bonding surface 22*a*.

In the second step, for example, the end portion of the shaft 4 on the first axial direction C1 side in a state of the rotor yoke 9 being press-fitted and fixed is inserted into the second hole 33 of the bladed main plate 13. As a result, the rotor yoke 9 and the bladed main plate 13 are coaxially (concentrically) disposed.

In the subsequent third step, the bladed main plate 13 is placed on the first axial direction C1 side with respect to the rotor yoke 9. For example, the bladed main plate 13 is placed on the first axial direction C1 side with respect to the rotor yoke 9 by being pushed toward the second axial direction C2 side up to a position where the protrusion 50 abuts on the bonding surface 22*a*. Accordingly, the centrifugal fan 1 is brought into the attached state.

When the bladed main plate 13 is placed on the rotor yoke 9, the second tubular portion 35 is disposed at the position surrounding the first tubular portion 23 from the radially outside. As a result, as shown in FIG. 5, the inner tube surface 35*f* of the second tubular portion 35 is disposed so as to face the outer tube surface 23*f* of the first tubular portion 23 with the clearance S therebetween. In addition, since the bladed main plate 13 is placed on the rotor yoke 9, the adhesive applied to the annular end surface 38*a* does not fit in the gap between the annular end surface 38*a* and the bonding surface 22*a*, and spreads (expands) not only between the annular end surface 38*a* and the bonding surface 22*a* but also between the rectangular end surface 39*a* and the bonding surface 22*a*. That is, the third step can also be said to be a step of making the inner tube surface 35*f* of the second tubular portion 35 face the outer tube surface 23*f* of the first tubular portion 23 with the clearance S therebetween, and expanding the adhesive between each of the annular end surface 38*a* and the rectangular end surface 39*a* and the bonding surface 22*a*.

When an excessive amount of adhesive is applied to the annular end surface 38*a*, the adhesive also spreads (expands) to the radially inside of the annular rib portion 38, the radially outside of the annular rib portion 38, and both sides of the auxiliary rib portion 39 in the circumferential direction. As shown in FIGS. 5 and 6, the expanded adhesive also comes into contact with the inner peripheral surface 38*b*, the outer peripheral surface 38*c*, and the side surfaces 39*d*. Since the adhesive expanded to each surface is cured with time, the bonding portion 40 is eventually formed. When the adhesive is cured, the centrifugal fan 1 is brought into the fixed state.

Note that the shroud 14 may be fixed to the bladed main plate 13 before or after the first, second, and third steps. The stator 6 may be fixed and the shaft 4 may be attached to the bearing holder 12 before or after the first, second, and third steps. The shaft 4 may be inserted into the first hole 21 and the second hole 33 after the first, second, and third steps.

3. Features and Effects (1) In the centrifugal fan 1 described above, the clearance S is formed between the outer tube surface 23*f* of the first tubular portion 23 and the inner tube surface 35*f* of the second tubular portion 35. As a result, even when the centrifugal fan 1 is used in the environment where the temperature change is great, the diameter-reducing deformation of the second tubular portion 35 due to the temperature change is allowed, so that the upward deformation of the main portion 34 due to the blocking of the diameter-reducing deformation of the second tubular portion 35 can be reduced. Therefore, the misalignment of the position of the center of gravity of the fan unit 3 can be reduced.

The centrifugal fan 1 described above is provided with the annular rib portion 38 and the plurality of auxiliary rib portions 39 as the rib portion 36 to be bonded and fixed to the rotor yoke 9 instead of the second tubular portion 35. In addition, in the centrifugal fan 1 described above, the bonding portion 40 formed of the adhesive is interposed not only between the annular end surface 38*a* and the bonding surface 22*a* but also between each of the rectangular end surfaces 39*a* of the plurality of auxiliary rib portions 39 and the bonding surface 22*a*. As a result, the fan unit 3 can be fixed to the rotor yoke 9 with a higher bonding strength than that when only the annular end surface 38*a* and the bonding surface 22*a* are bonded and fixed. As compared with a configuration in which the width of the annular end surface 38*a* in the radial direction is simply increased in order to increase the bonding area, providing the plurality of auxiliary rib portions 39 radially extending from the annular rib portion 38 in the radial direction to ensure the bonding area also contributes to reduction in material cost and weight. In addition, in a case where the fan unit 3 is made of resin, the shape distortion caused by the difference in curing time due to the difference in resin amount can also be reduced. Therefore, according to the centrifugal fan 1 described above, it is possible to effectively reduce the misalignment of the position of the center of gravity due to the thermal deformation while ensuring the strength of the bonding of the fan unit 3 to the rotor 5. Further, since the auxiliary rib portions 39 radially extend to the radially outside from the annular rib portion 38, the flowability of the resin during molding is improved, and the finishing accuracy of the fan unit 3 such as flatness and parallelism can be improved.

(2) The bonding portion 40 is provided not only between the bonding surface 22*a* and each of the annular end surface 38*a* and the rectangular end surface 39*a* but also over each of the inner peripheral surface 38*b* and outer peripheral surface 38*c* of the annular rib portion 38 and the side surfaces 39*d* of the auxiliary rib portions 39, so that the strength of bonding of the fan unit 3 to the rotor 5 can be further increased. In particular, the bonding strength in the circumferential direction (i.e., the rotation direction of the fan unit 3) is further enhanced.

(3) In a case where the main portion 34 extends to the radially outside and the second axial direction C2 side from the second hole 33, the fluid sucked from the first axial direction C1 side can be smoothly pushed outward in the second axial direction C2 and the radial direction along the main portion 34. Therefore, the air blowing efficiency of the fan unit 3 can be improved. In addition, since it is possible to reduce swirling of the fluid on the radially inside of the fan unit 3, noise of the fan unit 3 is also reduced.

(4) In a case where the main portion 34 extends to the radially outside and the second axial direction C2 side from the second hole 33, if the auxiliary rib portion 39 is provided not on the radially inside but on the radially outside of the annular rib portion 38, the amount of protrusion of the auxiliary rib portion 39 from the main portion 34 can be reduced. When the bladed main plate 13 is made of resin, the shape distortion caused by the difference in curing time due to the difference in resin amount during molding can be reduced by reducing the protruding amount of the auxiliary rib portion 39.

(5) When the rib portion 36 including the annular rib portion 38 and the plurality of auxiliary rib portions 39 is provided at the position apart from the second tubular portion 35 in the radial direction, it is possible to reduce the blocking of the diameter-reducing deformation of the second tubular portion 35 by the rib portion 36 fixed to the bonding surface 22*a*. As a result, it is possible to reduce the replacement of the force of the diameter-reducing deformation of the second tubular portion 35 with the upward deformation of the main portion 34, and thus, it is possible to effectively reduce the misalignment of the position of the center of gravity of the fan unit 3.

(6) When the rib portion 36 is provided at the position apart from the second hole 33 in the radial direction, it is possible to reduce the protruding amount of the rib portion 36 from the main portion 34 extending to the radially outside and the second axial direction C2 side. Therefore, the moldability of the bladed main plate 13 having the second hole 33, the main portion 34, the second tubular portion 35, and the rib portion 36 can be improved. Further, when the annular rib portion 38 is provided at the position apart from the second hole 33, the area of the annular end surface 38*a* of the annular rib portion 38 is increased. Therefore, the bonding area can be increased, and the bonding strength can be improved.

(7) When the bladed main plate 13 is made of resin, the bladed main plate 13 having the second hole 33, the main portion 34, the second tubular portion 35, and the rib portion 36 can be easily molded using resin having a higher moldability than that of metal. In addition, since the rotor yoke 9 is made of metal which is less likely to be thermally deformed than resin, the thermal deformation of the rotor yoke 9 due to the temperature change is reduced. Therefore, the misalignment of the position of the center of gravity of the fan unit 3 can be more effectively reduced.

(8) In the fixing method described above, the fixing of the bladed main plate 13 to the rotor yoke 9 is completed only by applying the adhesive only to the annular end surface 38*a* (first step), making the bladed main plate 13 face the rotor yoke 9 (second step), and placing the bladed main plate 13 on the rotor yoke 9 (third step). Therefore, the centrifugal fan 1 in which the position of the center of gravity of the fan unit 3 is less likely to be misaligned and the bonding strength is maintained can be configured by a simple method.

4. Others

The configuration of the above-described centrifugal fan 1 is an example, and is not limited to the above-described configuration. The fixing method described above is also an example, and is not limited to the method described above. In the first step, the adhesive may be applied to the rotor yoke 9. More specifically, in the first step, when the main portion 34 is disposed on the first axial direction C1 side with respect to the top portion 22 on the bonding surface 22*a* of the rotor yoke 9, the adhesive may be applied to a portion facing the annular end surface 38*a*.

The top portion 22 of the rotor yoke 9 may not be the surface portion extending to the radially outside and the second axial direction C2 side, and may be, for example, a surface portion simply extending to the radially outside (orthogonal to the axial direction) from the first hole 21. The top portion 22 does not necessarily include the plurality of portions 24 to 28 different in the extending direction.

The first tubular portion 23 only needs to extend in the second axial direction C2 from at least the radially outside end portion of the top portion 22, and may not be the portion to which the magnet 8 is fixed or may not be the portion surrounding the stator core 7 from the radially outside. That is, in the centrifugal fan 1 described above, the rotor yoke 9 is provided as the "first portion" described in the claims, but the "first portion" described in the claims may not be the rotor yoke 9.

The rotor 5 may be provided with a portion (component) corresponding to the "first portion" described in the claims, separately from the rotor yoke 9. Such a portion may not have the cup shape as in the rotor yoke 9. The "first portion" described in the claims only needs to be made of at least a material having a smaller linear coefficient of expansion than that of the "second portion" described in the claims, and may not be made of metal. Note that the motor unit 2 may be an inner rotor type motor.

The annular end surface 38*a* only needs to have the annular shape extending around at least the axis C, and may have, for example, a polygonal outer shape as viewed in the axial direction. The plurality of auxiliary rib portions 39 may not all have the same shape, and may extend to the radially inside from the annular rib portion 38. The number of auxiliary rib portions 39 is not limited to 12, and only needs to be two or more (plural number). The end surface 39*a* of the auxiliary rib portion 39 may not be the rectangular. The protrusion 50 provided on the auxiliary rib portion 39 may be omitted.

The main portion 34 of the fan unit 3 may not be the surface portion extending to the radially outside and the second axial direction C2 side from the second hole 33, and may be, for example, a surface portion simply extending to the radially outside (orthogonal to the axial direction) from the second hole 33. The second tubular portion 35 only needs to have at least the tubular shape having the inner tube surface 35*f* extending in the second axial direction C2 from the radially outside end portion of the main portion 34 and facing the outer tube surface 23*f* of the first tubular portion 23 with the clearance S therebetween, and may not have the cylindrical shape. The second tubular portion 35 may have, for example, a tubular shape having a polygonal outer shape as viewed in the axial direction. Similarly, the first tubular portion 23 may have, for example, a tubular shape having a polygonal outer shape as viewed in the axial direction.

The second hole 33, the main portion 34, the second tubular portion 35, and the rib portion 36 only need to be at least portions provided for the fan unit 3 having the plurality of blades 31, and may be portions (components) provided separately from the bladed main plate 13. That is, the "second portion" described in the claims may not be part of the bladed main plate 13. The shroud 14 of the fan unit 3 may be omitted, and the blades 31 and the main plate portion 32 are not necessarily integrally molded as the bladed main plate 13.

The "second portion" described in the claims only needs to be made of at least a material having a greater linear coefficient of expansion than that of the "first portion" described in the claims, and may not be made of resin. Both the "first portion" and the "second portion" described in the claims may be made of resin or metal as long as these portions satisfy the relationship of the linear coefficient of expansion.

DESCRIPTION OF REFERENCE SIGNS

1 Centrifugal fan
2 Motor unit
3 Fan unit
4 Shaft
5 Rotor
21 First hole
22 Top portion
22*a* Bonding surface (flat surface)
23 First tubular portion
23*f* Outer tube surface
31 Blade
33 Second hole
34 Main portion
35 Second tubular portion
35*f* Inner tube surface
38 Annular rib portion
38*a* Annular end surface
38*b* Inner peripheral surface
38*c* Outer peripheral surface
39 Auxiliary rib portion
39*a* Rectangular end surface (end surface)
39*d* Side surface
40 Bonding portion
C1 First axial direction
C2 Second axial direction
S Clearance

The invention claimed is:

1. A centrifugal fan comprising:

a first portion provided in a rotor that rotates integrally with a shaft; and a second portion provided in a fan unit having a plurality of blades and fixed to the rotor and having a greater linear coefficient of expansion than that of the first portion, wherein the first portion includes a top portion extending from a first hole through which the shaft is inserted toward a radially outside of the shaft and having a flat surface facing a first axial direction in an axial direction of the shaft, and a first tubular portion having a tubular shape and extending from a radially outside end portion of the top portion in a second axial direction opposite to the first axial direction, the second portion includes a main portion located in the first axial direction with respect to the top portion and extending to the radially outside from a second hole through which the shaft is inserted, an annular rib portion protruding from the main portion in the second axial direction and having an annular end surface having an annular shape and facing the flat surface, a plurality of auxiliary rib portions protruding from the main portion in the second axial direction, radially extending from the annular rib portion in a radial direction, and having end surfaces facing the flat surface, and a second tubular portion having a tubular shape, extending from a radially outside end portion of the main portion in the second axial direction, and having an inner tube surface facing an outer tube surface of the first tubular portion with a clearance therebetween, and a bonding portion formed of an adhesive is provided between the annular end surface of the annular rib portion and each of the end surfaces of the plurality of auxiliary rib portions, and the flat surface.

2. The centrifugal fan according to claim 1, wherein the bonding portion is provided over an inner peripheral surface of the annular rib portion, an outer peripheral surface of the annular rib portion, and a side surface of each of the auxiliary rib portions facing a circumferential direction of the shaft.

3. The centrifugal fan according to claim 1, wherein the main portion extends to the radially outside and a second axial direction side from the second hole.

4. The centrifugal fan according to claim 3, wherein the plurality of auxiliary rib portions radially extends to the radially outside from the annular rib portion.

5. The centrifugal fan according to claim 3, wherein the annular rib portion and the plurality of auxiliary rib portions are provided at positions apart from the second tubular portion in the radial direction.

6. The centrifugal fan according to claim 5, wherein the annular rib portion and the plurality of auxiliary rib portions are provided at positions apart from the second hole in the radial direction.

7. The centrifugal fan according to claim 1, wherein the first portion is made of metal, and the second portion is made of resin.

8. A fixing method for fixing, to a first portion provided in a rotor of a motor unit having the rotor that rotates integrally with a shaft and a stator disposed so as to face the rotor, a second portion provided in a fan unit having a plurality of blades and having a greater linear coefficient of expansion than that of the first portion, the first portion being provided with a top portion extending to a radially outside from a first hole through which the shaft is inserted and having a flat surface facing a first axial direction, and a first tubular portion extending from a radially outside end portion of the top portion in a second axial direction opposite to the first axial direction, and the second portion being provided with a main portion extending to the radially outside from a second hole through which the shaft is inserted, an annular rib portion protruding from the main portion and having an annular end surface having an annular shape, a plurality of auxiliary rib portions protruding from the main portion in a direction identical to that of the annular rib portion, radially extending from the annular rib portion in a radial direction, and having end surfaces facing a direction identical to that of the annular end surface, and a second tubular portion extending from a radially outside end portion of the main portion in a direction identical to that of the annular rib portion, the fixing method comprising:

a first step of applying an adhesive to the annular end surface or applying an adhesive to a portion facing the annular end surface when the main portion of the second portion is disposed on a first axial direction side with respect to the top portion of the first portion on the flat surface;

a second step of disposing the main portion of the second portion on the first axial direction side with respect to the top portion of the first portion and making the annular end surface and the end surfaces face the flat surface; and a third step of making an inner tube surface of the second tubular portion face an outer tube surface of the first tubular portion with a clearance therebetween and expanding the adhesive between the annular end surface and the flat surface and between the end surfaces and the flat surface.

* * * * *